US011040864B2

(12) United States Patent
Savese

(10) Patent No.: US 11,040,864 B2
(45) Date of Patent: Jun. 22, 2021

(54) APPARATUS FOR DRAWING BEVERAGES

(71) Applicant: Savese S.r.l., Orbassano (IT)

(72) Inventor: Marcello Savese, Rivalta di Torino (IT)

(73) Assignee: SAVESE S.R.L., Orbassano (IT)

( * ) Notice: Subject to any disclaimer, the term of this patent is extended or adjusted under 35 U.S.C. 154(b) by 0 days.

(21) Appl. No.: 16/858,786

(22) Filed: Apr. 27, 2020

(65) Prior Publication Data

US 2020/0354209 A1 Nov. 12, 2020

(30) Foreign Application Priority Data

May 10, 2019 (IT) ..... 102019000006742

(51) Int. Cl.
*B67D 1/04* (2006.01)
*B67D 1/00* (2006.01)

(52) U.S. Cl.
CPC .... *B67D 1/0431* (2013.01); *B67D 2001/0097* (2013.01); *B67D 2001/0098* (2013.01)

(58) Field of Classification Search
CPC ..... B67D 1/07; B67D 2001/0097; B67D 2001/0098; B08B 9/02; B08B 9/027; B08B 9/032; B67C 1/0431
USPC ..... 222/146.6
See application file for complete search history.

(56) References Cited

U.S. PATENT DOCUMENTS 2,263,922 A * 11/1941 Guttman ..... B08B 9/0321 134/93
6,349,853 B1 * 2/2002 Grampassi ..... B67D 1/0009 222/144.5
2006/0113322 A1 * 6/2006 Maser ..... B67D 1/07 222/129.1
2010/0243676 A1 * 9/2010 Bax ..... B67D 1/07 222/148
2010/0276452 A1 * 11/2010 Vesborg ..... B67D 1/125 222/144.5
2011/0220159 A1 * 9/2011 Ellickson ..... B08B 9/00 134/198
2012/0132673 A1 * 5/2012 Leyva ..... B67D 1/0868 222/146.6
2013/0146096 A1 * 6/2013 Pickett ..... B67D 1/07 134/22.12
2015/0129617 A1 * 5/2015 Peirsman ..... B67D 1/0857 222/399
2016/0031695 A1 2/2016 Hecht et al.
2016/0060089 A1 * 3/2016 Netter ..... B67D 1/0869 222/82
2016/0355389 A1 * 12/2016 Bursey ..... B67D 1/0884
(Continued)

FOREIGN PATENT DOCUMENTS

WO 2016193871 A1 8/2016

OTHER PUBLICATIONS

Italian Search Report and Written Opinion dated Jan. 22, 2020, based on Italian Patent Application No. 102019000006742.

*Primary Examiner* — Benjamin R Shaw
(74) *Attorney, Agent, or Firm* — Heslin Rothenberg Farley & Mesiti P.C.; Victor A. Cardona, Esq.

(57) ABSTRACT

Apparatus for drawing beverages, particularly beer, contained in barrels with a limited capacity, having a washing device for a beverage dispensing circuit thereof. Such washing device includes a duct which can be connected to a water supply and is connected to a washing head arranged on the casing of the apparatus and that can be coupled to the connector of the dispensing circuit.

7 Claims, 4 Drawing Sheets

(56) References Cited

U.S. PATENT DOCUMENTS

| | | | | |
|---|---|---|---|---|
| 2017/0129760 | A1* | 5/2017 | Aneson | B05B 15/555 |
| 2017/0240409 | A1* | 8/2017 | Valles | B67D 1/0842 |
| 2018/0086620 | A1* | 3/2018 | Smith | B67D 1/07 |
| 2018/0162712 | A1* | 6/2018 | Savese | B67D 3/0029 |
| 2018/0362319 | A1* | 12/2018 | Park | B67D 1/07 |
| 2019/0015879 | A1* | 1/2019 | Pickett | B67D 1/1202 |
| 2020/0002149 | A1* | 1/2020 | Pickett | B08B 9/0325 |
| 2020/0247657 | A1* | 8/2020 | Christiansen | B67D 1/0882 |

* cited by examiner

APPARATUS FOR DRAWING BEVERAGES

CROSS REFERENCE TO RELATED APPLICATIONS

This application claims priority from Italian Patent Application No. 102019000006742 filed on May 10, 2019, the entire disclosure of which is incorporated herein by reference.

FIELD OF THE INVENTION

The present invention generally regards a compact apparatus for drawing a beverage contained in a barrel of reduced capacity, particularly beer, and comprising a compartment for housing the barrel.

STATE OF THE PRIOR ART

Patent application EP3303210A1 discloses a compact apparatus thus made for drawing a beverage comprising a casing in which a refrigeration unit for cooling the barrel of the beverage to be drawn is housed. Such apparatus is further provided with a receptacle suitable to contain such barrel.

With an apparatus of this type there is the problem of cleaning the beverage dispensing circuit which, as is also known for conventional drawing apparatuses, i.e. designed to operate with standard capacity barrels arranged outside the drawing device, must be cleaned periodically for example by means of a suitable device containing a cleaning liquid to be connected to the beverage dispensing circuit.

Such dispensing circuit comprises, in a known manner, a duct for supplying compressed air from a compressor to the barrel, a pipe for supplying the beverage under pressure to a drawing tap and a connector of the duct and of the pipe provided with a quick coupling which can be coupled with the barrel.

The cleaning of such circuit, in particular of the beverage pipe, is essential to ensure that no residues of the beverage which can affect the quality of the beverage from the health point of view are formed in the dispensing circuit.

SUMMARY OF THE INVENTION

The object of the present invention is to overcome the aforementioned problem. With the aim of achieving such object, the invention regards an apparatus for drawing beverages of the type defined in the preamble of claim 1, whose primary characteristic lies in the fact that it comprises a device for washing the beverage dispensing circuit comprising a duct which can be connected at one end to a water mains and connected at the other end to a washing head arranged on the casing and which can be coupled to the connector of the dispensing circuit.

In a preferred embodiment of the invention, the compressor for supplying compressed air to the barrel is integrated in the apparatus.

In an embodiment, the dispensing apparatus is provided with a receptacle for glasses arranged above and behind the compartment and refrigerated by the refrigeration unit.

According to a further aspect of the invention, the washing device comprises a tap which can be actuated selectively to open and close the flow of the washing water from the head.

BRIEF DESCRIPTION OF THE DRAWINGS

The invention will now be described in detail with reference to the attached drawings, provided purely by way of non-limiting example, wherein.

DETAILED DESCRIPTION OF THE INVENTION

Figure 1:
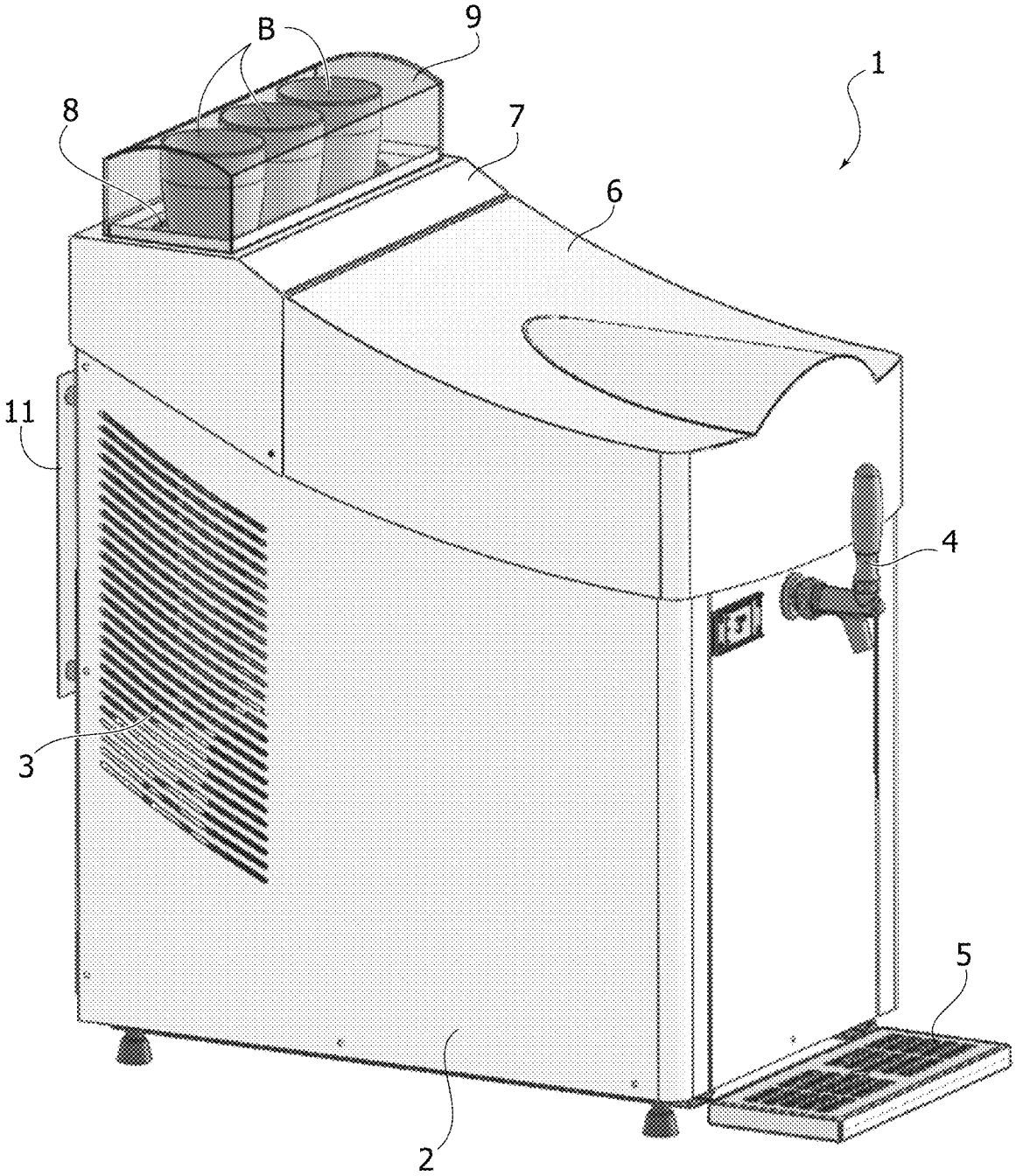
FIG. 1 is a schematic front perspective view of an embodiment of the apparatus for drawing beverages according to the invention.

Initially with reference to FIG. 1, an apparatus for drawing beverages comprising a casing 2 having dimensions such to be suitable to be positioned on the counter of business premises or even easily used at home, is illustrated generally indicated with 1. The front part of the casing 2 has a drawing tap 4 projecting above a grid 5 for positioning a glass B designed to house the beverage, typically beer.

The casing 2 is provided with lateral air intakes 3 and it is provided with a front lid 6 and with a rear lid 7.

The apparatus for drawing beverages 1 is of the generally conventional type and therefore only the essential components thereof and the components expressly referred to in the invention will be described.

The rear lid 7 has a receptacle 8 provided with an openable cover 9, for example transparent, and it is suitable to contain one or more glasses B.

Figure 3:
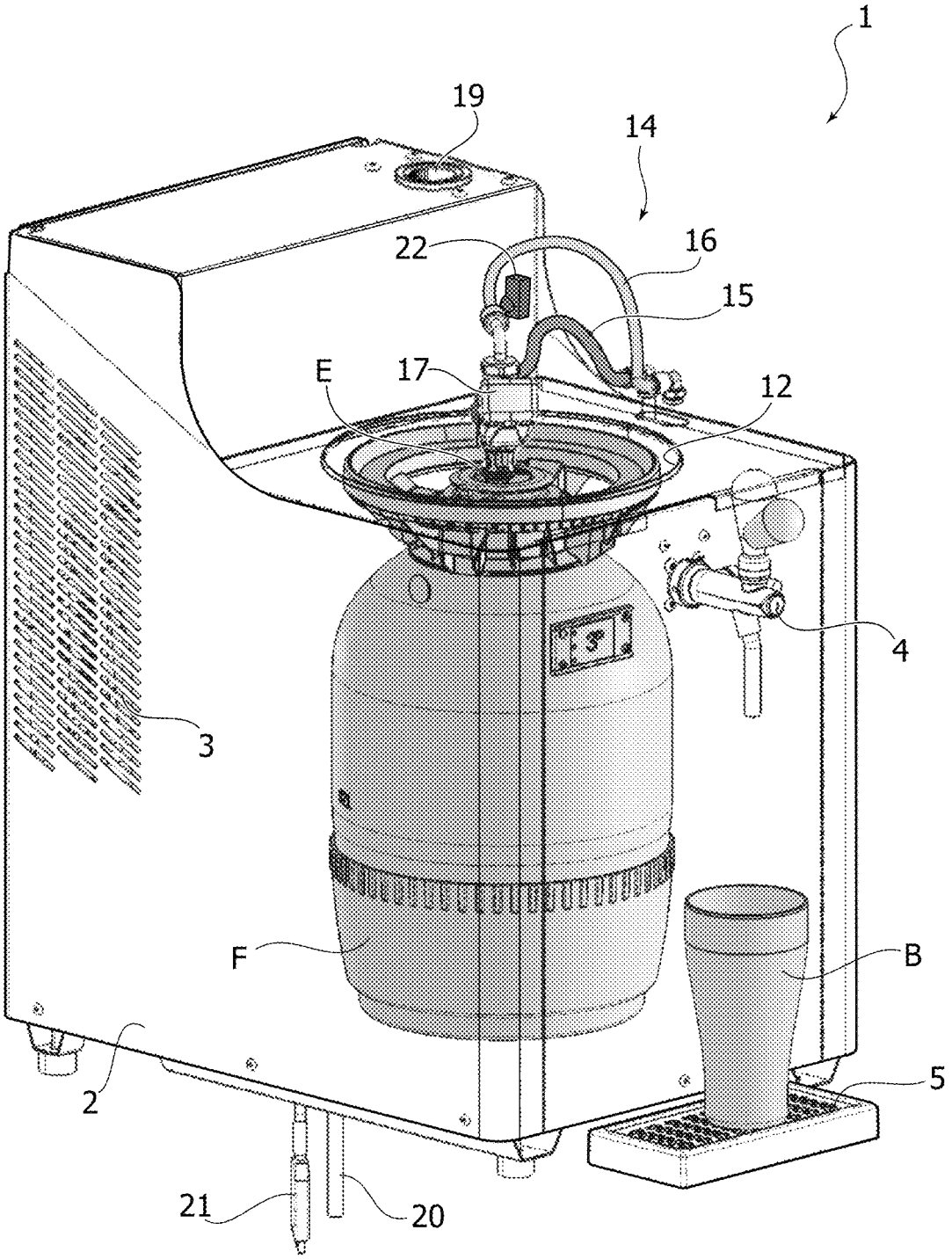
Figure 4:
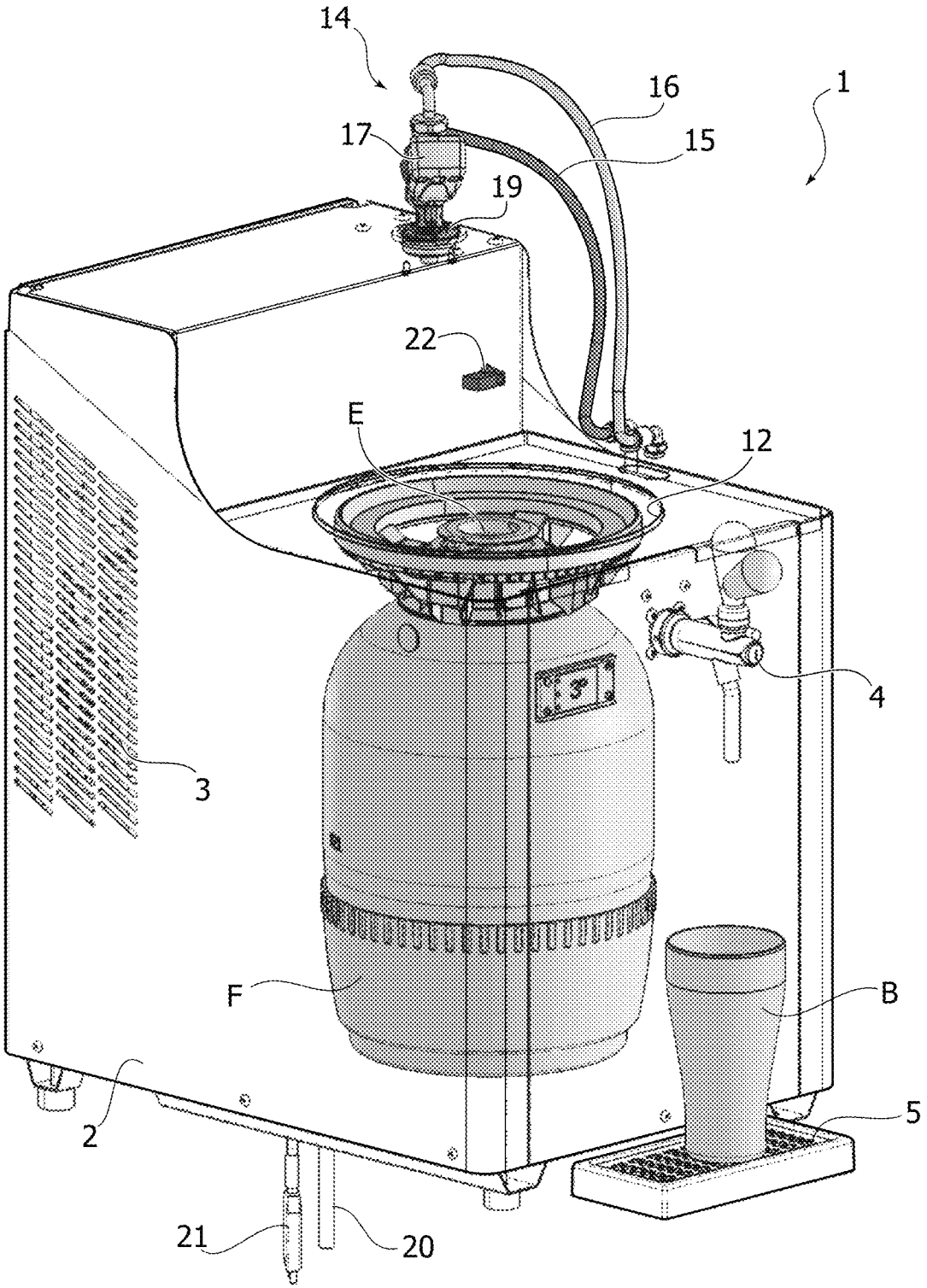

The front lid 6 is designed to cover a front portion of the casing 2, visible in FIGS. 3 and 4, and is shaped like a compartment 12 for housing a barrel or keg F of reduced capacity, typically of the order of 12 litres, containing the beverage to be drawn. The barrel F is provided—at the top—in a known manner, with a dispensing mouth E.

Figure 2:
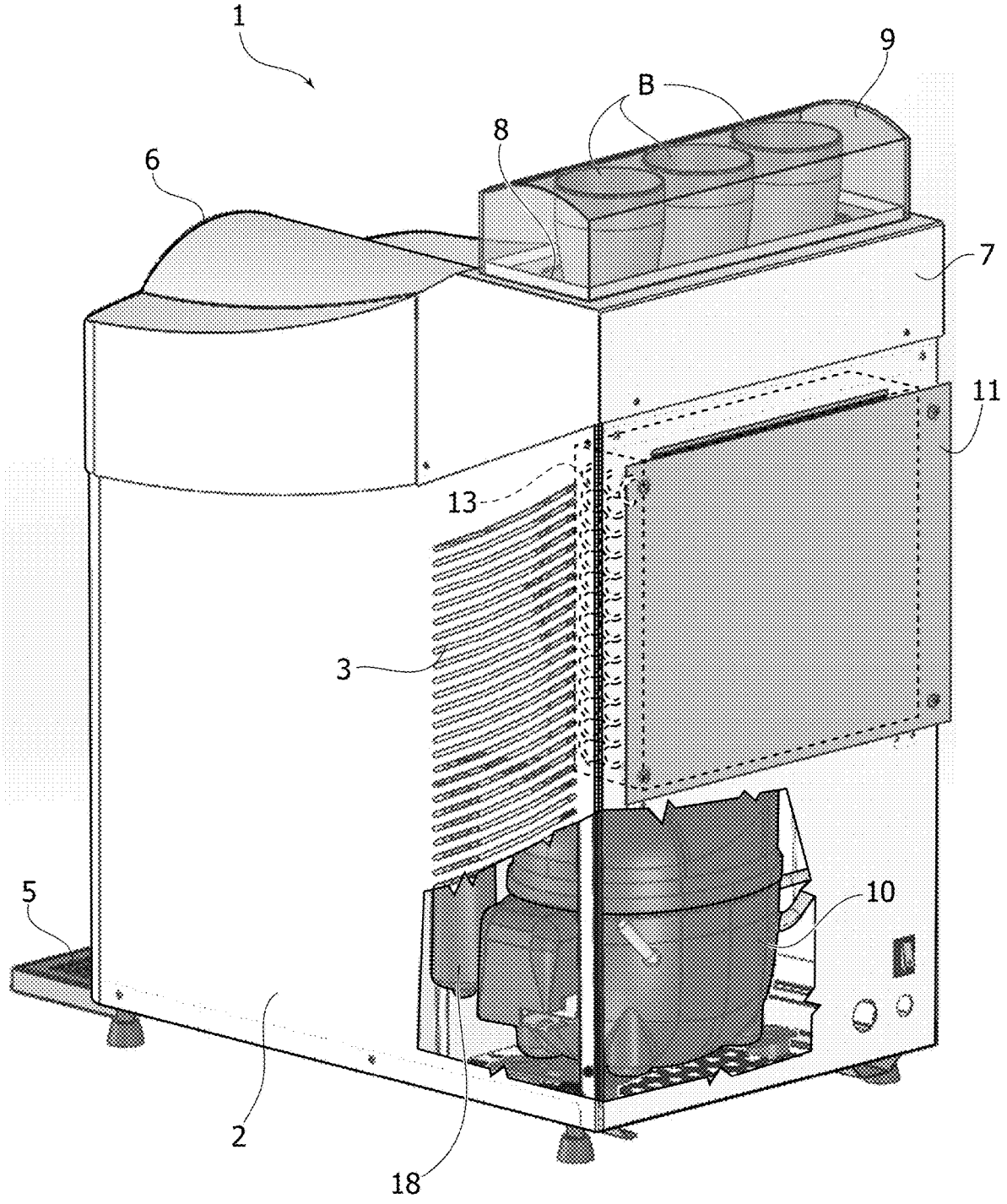
FIG. 2 is a dorsal perspective view of FIG. 1, FIGS. 3 and 4 are perspective views in partial transparency of FIG. 1 showing two different operating conditions of the apparatus.

Now, with reference to FIG. 2, the rear part of the casing 2 houses a refrigeration unit comprising, in a conventional manner, a compressor 10, a condenser 11 and a double evaporator. A first evaporator, not shown in the figures due to the fact that it is generally known, is applied in proximity of the receptacle 8 to cool the glasses B contained therein. A second evaporator, indicated with 13, is arranged in proximity of the compartment 12 to cool the barrel F.

Inside the casing 2 and in proximity of the compressor 10 there is also provided an air compressor 18, which will be addressed hereinafter.

Once again with reference to FIGS. 3 and 4, the beverage dispensing circuit is indicated in its entirety with number 14. Such circuit 14 comprises a duct 15 which connects the air compressor 18 to the barrel F, a pipe 16 for supplying the beverage contained in the barrel F to the drawing tap 4, and a connector 17 to which the duct 15 and the pipe 16 are connected. Such connector 17 is provided with a quick coupling which can be coupled to the dispensing mouth E of the barrel F.

On the rear part of the casing 2, under the second lid 7, there is arranged—according to the invention—a washing device 19, 20 of the beverage dispensing circuit 14 which will be described in detail hereinafter.

Such washing device comprises a so-called washing head 19 arranged for coupling with the quick coupling of the connector 17 of the dispensing circuit 14. The washing head 19 substantially consists of a coupling shaped in a manner similar to the dispensing mouth E of the barrel F.

The washing head 19 is configured to be connected to an external water main by means of a duct 20 which protrudes from the lower part of the casing 2.

Further provided in a portion of the casing 2 in proximity of the compartment 12 is a tap 22 that can be selectively actuated to close and open the flow of water from the external mains to the washing head 19.

The apparatus for drawing beverages 1 according to the invention is further provided, in a per se know manner too, with a programmable electronic control unit, not shown in the figures, for adjusting the cooling temperature of the compartment 12 and of the receptacle 8 to pre-set values. This control unit acts by regulating the operation of the refrigeration unit and it can be connected to the mains by means of an electrical cable 21.

The operation of the apparatus for drawing beverages 1 according to the invention will now be described in the operative condition for dispensing the beverage, schematically represented in FIG. 3, and in the condition for washing the dispensing circuit 14 represented in FIG. 4.

Once connected to the water mains and to the power mains, the drawing apparatus 1 is ready to operate when the temperature of the barrel F reaches the pre-set value thanks to the refrigeration unit 10, 11, 13. In order to draw the beverage, it is necessary to insert the quick coupling of the connector 17 of the dispensing circuit 14 into the dispensing mouth E of a full barrel F housed in the compartment 12 and close the lid 6. By acting on the drawing tap 4, the compressor 18, which supplies compressed air by means of the duct 15 in the barrel F, is actuated increasing the pressure of the drink contained therein. Such pressure increase allows the beverage to flow through the pipe 16 up to the tap 4 where it will be drawn into a glass B placed on the grid 5.

Whenever there arises the need to wash the dispensing circuit 14, for example when replacing an empty barrel with a full barrel, it is sufficient to remove the two lids 6 and 7, disconnect the connector 17 of the dispensing circuit 14 from the barrel F and insert it into the washing head 19 as shown in FIG. 4. Subsequently, by opening the washing tap 22, the water from the water mains is introduced into the connector 17 and into the pipe 16 cleaning them from any residues of the previously dispensed beverage, before flowing out from the drawing tap 4.

Once the washing of the dispensing circuit 14 has been carried out, it is possible to restore the drawing operation of the apparatus 1 by closing the washing tap 22, disconnecting the connector 17 of the dispensing circuit 14 from the washing head 19, replacing the barrel F if necessary, by re-inserting the connector 17 into the barrel F and closing the casing 2 with the respective lids 6 and 7.

Obviously, the construction details and the embodiments may widely vary with respect to what has been described and illustrated, without departing from the scope of protection of the present invention as defined in the claims that follow. Thus, for example, the general conformation of the casing 2 and the arrangement of the washing device 19, 20 and/or of the refrigerating unit 10, 11, 13 could be different from those shown in the drawings.

The invention claimed is:

1. Apparatus for drawing beverages contained in barrels having a limited capacity, comprising:

a casing provided with a compartment for housing said barrel, a refrigerating unit for refrigerating said barrel, an air compressor, a dispensing circuit of said beverage comprising:

a duct for supplying compressed air from said compressor to said barrel, a pipe for supplying the beverage under pressure to a drawing tap, a connector of said duct and of said pipe having a quick coupling that can be coupled with said barrel, device for washing said beverage dispensing circuit comprising a duct-connectable at a first end to a water supply and connected at a second end to a washing head arranged on said casing and designed to be coupled to said connector.

2. Apparatus according to claim 1, wherein said air compressor is integrated within the apparatus.

3. Apparatus according to claim 1 further comprising a receptacle for glasses arranged above and behind said compartment and refrigerated by said refrigerating unit.

4. Apparatus according to claim 1 wherein said washing device comprises a tap which can be actuated selectively to open and close the flow of the washing water of said dispensing circuit.

5. Apparatus according to claim 2 further comprising a receptacle for glasses arranged above and behind said compartment and refrigerated by said refrigerating unit.

6. Apparatus according to claim 2 wherein said washing device comprises a tap which can be actuated selectively to open and close the flow of the washing water of said dispensing circuit.

7. Apparatus according to claim 3 wherein said washing device comprises a tap which can be actuated selectively to open and close the flow of the washing water of said dispensing circuit.

* * * * *